US009677244B2

(12) United States Patent
Kusuma et al.

(10) Patent No.: US 9,677,244 B2
(45) Date of Patent: Jun. 13, 2017

(54) RETAINING WALL

(75) Inventors: Surya Kusuma, Singapore (SG); Andreas Schwarz, Bern (CH)

(73) Assignee: VSL INTERNATIONAL AG, Köniz (CH)

( * ) Notice: Subject to any disclaimer, the term of this patent is extended or adjusted under 35 U.S.C. 154(b) by 123 days.

(21) Appl. No.: 14/400,608

(22) PCT Filed: May 14, 2012

(86) PCT No.: PCT/EP2012/058947

§ 371 (c)(1),
(2), (4) Date: Nov. 12, 2014

(87) PCT Pub. No.: WO2013/170879

PCT Pub. Date: Nov. 21, 2013

(65) Prior Publication Data

US 2015/0125221 A1 May 7, 2015

(51) Int. Cl.

| | |
|---|---|
| ***E04G 15/04*** | (2006.01) |
| ***B28B 7/04*** | (2006.01) |
| ***B28B 7/16*** | (2006.01) |
| ***E02D 29/02*** | (2006.01) |
| *E04G 15/06* | (2006.01) |

(52) U.S. Cl.

CPC ..... *E02D 29/0233* (2013.01); *E02D 29/02* (2013.01); *E02D 29/0266* (2013.01); *B28B 7/04* (2013.01); *B28B 7/16* (2013.01); *E04G 15/068* (2013.01)

(58) Field of Classification Search

CPC ... E02D 29/0233; E02D 29/0266; B28B 7/04; B28B 7/16; E04G 15/04; E04G 15/06; E04G 15/061; E04G 15/063; E04G 15/068

USPC ..... 405/262, 284, 286; 249/184–186; 52/125.3; 264/31, 40.5, 333, 334, 336

See application file for complete search history.

(56) References Cited

U.S. PATENT DOCUMENTS 5,004,208 A * 4/1991 Domizio ..... E04G 15/04 249/177
5,523,046 A * 6/1996 Weder ..... A01G 9/02 156/277
5,651,911 A * 7/1997 Pennypacker ..... E04G 15/04 249/177

(Continued)

OTHER PUBLICATIONS

International Search Report and Written Opinion dated May 7, 2013 for PCT/EP2012/058947.

*Primary Examiner* — Sunil Singh
(74) *Attorney, Agent, or Firm* — Pearne & Gordon LLP

(57) ABSTRACT

Void former assembly for casting facing elements for reinforced earth. Anchoring recesses are cast into its rear face so that earth-reinforcing strips can be looped through. The anchoring recesses are each formed as a loop channel having a convex inner surface and a concave outer surface, at least one of which has a radius of curvature which increases from the deepest part of the recess towards the rear face. A removable void former assembly and method for casting such facing elements are also described. Because of the varying radius of curvature of the surfaces of the channel, and the rotational and translational withdrawal path of the void formers, the channel can be cast deeper, and with openings which are closer together, than has hitherto been possible using removable void formers.

19 Claims, 13 Drawing Sheets

(56) References Cited

U.S. PATENT DOCUMENTS 5,839,855 A * 11/1998 Anderson ..... E02D 29/0225
405/262
6,575,424 B2 * 6/2003 Domizio ..... E04G 21/142
249/170
7,127,859 B2 * 10/2006 Domizio ..... B28B 23/005
249/185

* cited by examiner

RETAINING WALL

The present invention relates to facing elements for reinforced fill retaining walls, and to formers and methods for casting strip anchorage channels in such facing elements. In particular, but not exclusively, the invention relates to the use of reusable void formers for casting strip anchorage channels in concrete facing panels.

BACKGROUND OF THE INVENTION

Earth fill reinforcement systems can be used, for example, to ensure stability and to minimize the lateral movement of a facing wall constructed to retain a volume of earth fill or rock material which is backfilled behind the wall. Such walls are used typically for separating regions of ground at two different levels.

The backfill material can be stabilized using lengths of strong, flat webbing or other flexible strip material, laid on successive layers of backfill material as the space behind the retaining wall facing is filled. The strips are attached to the rear side of the retaining wall and then tensioned away from the wall and pegged to the ground, such that when the next layer of backfill material is added, the strips are held in position, and the cumulative weight of the earth backfill on the strips produces sufficient friction between strips and earth to reinforce the backfill and hold the retaining wall in place.

Retaining or facing walls may be constructed from pre-cast concrete facing panels, for example, with each facing panel having several attachment points on its rear surface. These attachment points can be designed as loop channels, so that a retaining strip can be fed into one opening in the rear surface of the panel, through a channel inside the panel, and out through a second opening in the rear surface of the panel. Where loop-channel anchorages are used, the pre-cast panels are cast using void-formers so that the loop channels are formed as part of the casting process. Each loop channel is formed such that a flat, broad strip can be fed through the channel and around a part of the panel volume which will be termed the "core" of the channel in this application. This term is thus used to refer to that part of the volume of the panel around which the strip will pass when it is fed through the loop channel. It is the core which will bear the pulling force acting between the panel and the strip once the wall and the backfilling is complete. The core is typically a contiguous part of the panel material (reinforced concrete, for example, with some reinforcement passing through the core element), although the core may also be constructed from a different material (for example a cylinder of steel or carbon fibre, or high density concrete, which may be cast into the concrete of the body of the panel).

In order to provide a strong anchoring point, the loop-through channels should be cast as deep as possible into the volume of the panel, with a core which is also as deep as possible. A further consideration is that the two openings of the channel should be as close together as possible, in order that the strips emerging from the openings are not subjected to excessive local tension by the weight of the backfill material as it settles. Similarly, the load-bearing inner surface of the core element should have as large a radius of curvature as practicable, and have an even surface free of projections or discontinuities, in order to minimize the amount of localized stress on that part of the strip which is in contact with the core once the strip is under tension.

United States patent application U.S. Pat. No. 5,839,855 describes a pre-cast facing panel with loop-channels cast into its rear surface. The channels are formed by using plastic shell mould formers which are cast into the concrete and remain in the concrete. Cast-in mouldings must be in stock and available at the time of casting, and they represent a significant extra manufacturing cost.

The former arrangement described in U.S. Pat. No. 5,839,855 comprises two former-halves which are rotated about a common hinge which is located outside of the volume of the panel being cast. The inner and outer surfaces of each half-former have a constant radius of curvature over the inner region of the channel. In order for the void former to be removable without interference with the concrete, the hinge axis is located between the centre of curvature of the outer (forward-most) surface of the anchorage channel and the centre of curvature of the inner (rear-most) surface of the anchorage channel, with the result that the formed shape of the channel is limited to wide and/or shallow channel geometries. In particular, the restriction on the geometry of the inner surface of the half-formers means that there is an undesirable trade-off between the channel depth and the distance between the openings. The hinged construction also means that the former is necessarily bulky and heavy. The hinge axis must inevitably lie outside the concrete.

BRIEF DESCRIPTION OF THE INVENTION

The invention described in this application seeks to overcome the above and other difficulties inherent in the prior art. In particular, the invention aims to provide a removable void former which can be used to cast loop channels which are deeper and/or whose openings are closer together than those cast with prior art removable formers, while ensuring a large enough radius of curvature of the inner surface of the channels that the strips do not experience excessive localized stress.

To this end, the invention aims to provide a removable void former assembly for displacing a casting material to form a strip anchorage channel in a substantially planar rear face of a cast facing element during casting of the facing element, the facing element being for facing backfill stabilized by means of a flexible reinforcement strip passed through the channel such that the strip follows a substantially arcuate path between a first channel opening in the rear face, around a substantially cylindrical or cylindroidal core element, which is cast contiguously with the facing element casting, to a second channel opening in the rear face, wherein the removable channel void former assembly comprises:

a first void former, shaped for forming a first half of the channel, the first half extending between the first channel opening and an intermediate location in the channel, a second void former, shaped for forming a second part of the channel, the second half extending between the second channel opening and the intermediate location, support means for supporting the first and second void formers in position during casting of the facing element, and withdrawal displacement means for rotationally displacing the first and/or second void former about the core element in a rotational withdrawing direction from the channel of the cast facing element, wherein the withdrawal displacement means is adapted to permit, in addition to the rotational displacement of the first and/or second void former about the core element in a rotational withdrawing direction, a translational displacement of the first and/or second void former along a linear withdrawal direction.

The arrangement of the withdrawal displacement means for providing a combination of rotational and translational withdrawing displacements of the void formers enables the casting of deeper and/or narrower core elements, without the need for cast-in moulding inserts, and without needing to increase the width of the channel or the channel openings. It also permits the casting of more varied shapes of core element, According to a variant of the void former assembly of the invention, the withdrawal displacement means and/or the first and second void formers are configured such that the first and/or second void formers can only be withdrawn from the cast facing element by a combination of the rotational displacement and the linear translational displacement.

According to a variant of the void former assembly of the invention, the linear withdrawal displacement comprises a component perpendicular to the plane of the rear face. The linear withdrawal direction may be substantially perpendicular to the plane of the rear face. Alternatively, the linear withdrawal direction can be angled away from the perpendicular to the plane of the rear face, depending on the desired geometry of the channel being cast.

According to a further variant of the void former assembly of the invention, the support means comprise releasing means for mechanically decoupling the first void former from the second void former such that the first void former can be withdrawn from the cast facing element substantially without mechanical interaction between the first void former and the second void former. According to another variant of the void former assembly of the invention, the translational displacement of the first void former along the withdrawal direction is also a translation displacement relative to the second void former. By enabling the withdrawal of one void former independently of the other, it is possible to greatly increase the variety of shapes which are castable with the removable void former assembly, and also to cast recesses with deeper and/or narrower core elements.

According to another variant of the void former assembly of the invention, the first void former comprises a substantially cylindrically or cylindroidally curved wedge shaped portion having:

- a concave former surface region for forming a convex core surface region of the core element, the convex core surface region being a portion of the surface of the core element which has a surface normal directed away from the rear face,
- a convex former surface region for forming a concave channel surface region of the channel, the concave channel surface region being a portion of the surface of the channel which faces the convex core surface region,
- a distal end for cooperating with a corresponding distal end of the second void-former,
- wherein the radius of curvature of the concave former surface region varies, along at least a majority of the concave former surface region in a direction away from the distal end, and/or
- the radius of curvature of the convex former surface region varies, along at least a majority of the convex former surface region in a direction away from the distal end.

This variation in the radius of curvature of the concave and/or convex former surfaces enables deeper core elements to be cast, and with a greater variety of core element geometries.

According to another variant of the void former assembly of the invention, the radius of curvature of the concave former surface region decreases, or remains substantially constant, along at least a majority of the concave former surface region in a direction away from the distal end, and/or the radius of curvature of the convex former surface region increases, or remains substantially constant, along at least a majority of the convex former surface region in a direction away from the distal end. Such increasing and/or decreasing radii of curvature enable deeper channels/core elements to be cast, without significantly increasing the difficulty of withdrawing the void formers from the casting. If one or both of the concave former surface region and the convex former surface region remain(s) substantially constant, while the radius of curvature of the convex former surface region is significantly greater than that of the concave former surface region, then a similar advantage can be obtained, namely a deeper channel/core element, but without significantly increasing the difficulty of withdrawing the void formers from the casting.

According to another variant of the void former assembly of the invention, the withdrawal displacement means comprise lever engaging means for engagement with a lever such that the lever can be used to urge the first void former in the rotational withdrawing direction. The lever may be formed as part of the void former, or a separate lever may be used for inserting or engaging with the void former(s). In this way, the construction of the void formers can be simplified, and the void former assembly will be lighter and simpler.

According to another variant of the void former assembly of the invention, the concave former surface region of at least one of the first and second formers is shaped such that the rotational displacement has an axis of rotation which passes through the volume of the core element, the void of the channel, or the panel being cast.

With no hinge to dictate the rotational displacement path, the void formers can be withdrawn by rotating them about the core element, for example using a lever, which means that the channel openings can be cast significantly closer together.

According to another variant of the void former assembly of the invention, one or both of the first and second void formers comprises two or more former elements and one or more former element linking means for linking the two or more former elements together. Hingeing or otherwise linking multiple pieces together to make up the void former(s) further expands the range of shapes of channel which can be cast with the removable void former.

The invention also envisages a method of casting a strip anchorage channel in a rear face of a cast facing element during casting of the facing element, the facing element being for facing earth stabilized by means of a flexible reinforcement strip passing through the channel such that the strip follows a substantially arcuate path between a first channel opening in the rear face, around a substantially cylindrical or cylindroidal core element, which is cast contiguously with the facing element casting, to a second channel opening in the rear face, the method comprising:

a mounting step of arranging a removable channel void former assembly as described above in a channel casting location of the facing element, an unsticking step of rotating the first void former sufficiently to release it from adhesive contact with the cast material, and a withdrawal step comprising a rotational displacement of the first void former about the core element, wherein the withdrawal step includes, in addition to the rotational displacement, a translational displacement of the first void former, the translational displacement having a directional component perpendicular to the rear face.

According to a variant of the method of the invention, the method includes a releasing step of operating the releasing means to mechanically decouple the first and second void formers from each other. As discussed above, the use of independently releasable and withdrawable void formers increases the range of shapes which are castable using the method.

According to another variant of the method of the invention, the translational displacement comprises a relative displacement between the first and second formers, along a direction substantially perpendicular to the rear face.

According to another variant of the method of the invention, the rotational displacement comprises a rotation about a rotation axis which passes through the body of the facing element, or through the core element, or through the void of the channel.

The invention also envisages a cast facing element for facing a stabilized earth structure by securing a flexible reinforcement strip through a recessed channel in a substantially planar rear face of the facing element, wherein:

the channel follows a substantially arcuate path around a substantially cylindrical or cylindroidal core element such that the reinforcement strip can be passed through the channel from a first opening in the rear face, through the channel and around the core element, to a second opening in the rear face;

the channel is formed, without a cast-in channel-formwork insert, as a void cast into in the body of the facing element, such that the void of the channel delimits a convex core surface region of the core element and a concave channel surface of the channel; and the outer channel surface comprises at least one concave channel surface region having a centre of curvature which lies in the body of the facing element, or in the core element, or in the void of the channel.

According to variant of the cast facing element of the invention, the core element is cast, without a cast-in core-forming insert, contiguously with the casting material of the facing element.

In this application, the example of a planar facing panel is used to illustrate the invention. However, it should be understood that the invention can also be applied to facing elements which are curved or profiled. The rear surface of the facing element may be provided with ribs or other surface profiles, for example, and terms such as "parallel to the rear face" should be understood to refer the general plane of the profiled rear face, or to a local approximation of the plane of the curved rear face, as appropriate. The scope of the claimed invention is intended to include such curved or profiled variants.

The invention and its advantages will further be explained in the following description, together with illustrations of example embodiments and implementations given in the accompanying drawings, in which.

Figure 1:
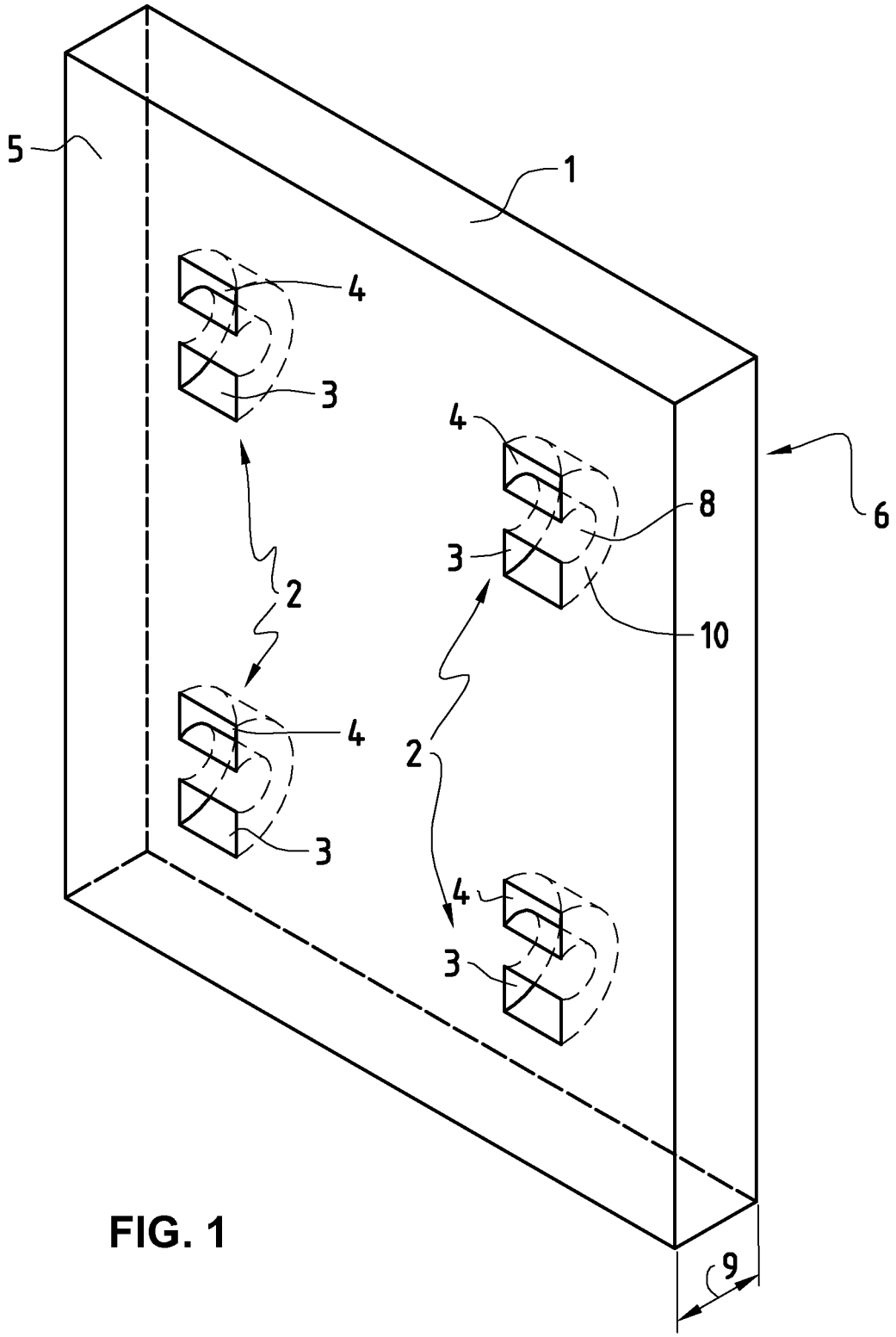
FIG. 1 shows an example of a facing element according to a first embodiment of the invention.

The invention will now be described in detail with reference to the drawings. Note that the drawings are intended merely as illustrations of embodiments of the invention, and are not to be construed as limiting the scope of the invention. Where the same reference numerals are used in different drawings, these reference numerals are intended to refer to the same or corresponding features.

FIG. 1 shows an example of a facing element/panel 1 with four strip-anchoring recesses 2 in the rear face 5. Each anchoring recess 2 comprises a channel 10 running from a first opening 3 to a second opening 4 around a channel core 8. The facing element 1 is shown as a solid, substantially rectilinear shape having a front face 6, a rear face 5 and a thickness 9. The recesses 2 are formed within the thickness 9 of the body of the facing element 1, and may extend through more than half of the thickness 9 in order to ensure that the core element 8 is as deep (and therefore as strong) as possible in the lateral (thickness) direction 9.

Figure 2:
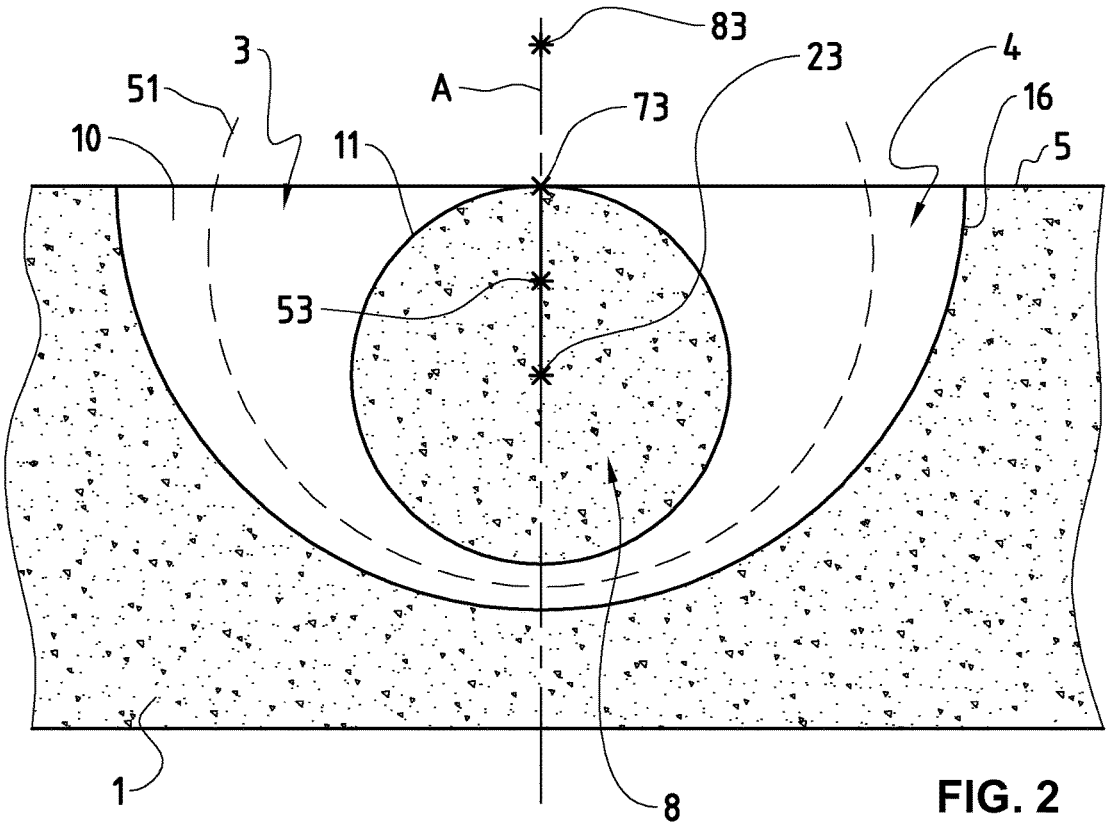
FIGS. 2 and 3 illustrate geometrical principles associated with the invention.
Figure 3:
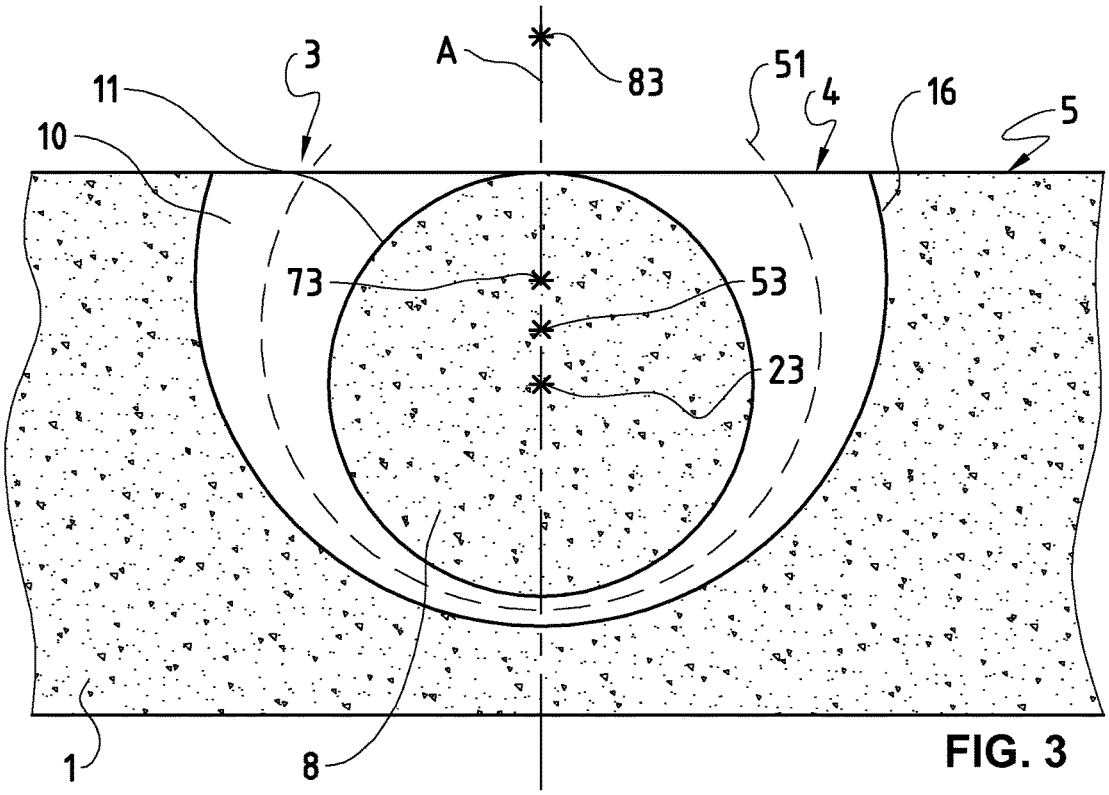

FIGS. 2 and 3 illustrate some concepts and features which will be used in this application to explain the embodiments of the invention. In each figure, an arcuate channel 10 is illustrated in a facing panel 1. The channel 10 has an outer surface 16 and an inner surface 11, formed around a core element 8. The inner surface 11 of the channel 10 is thus also the outer surface of the core element 8. Each channel 10 emerges at openings 3 and 4 in rear face 5 of the facing panel. An axis A is also shown, substantially perpendicular to the facing element 1.

The channels 10 shown in FIGS. 2 and 3 have a substantially constant radius of curvature, for ease of explanation. The centre of curvature of the outer surface 16 in each case is denoted by the reference 73, while the centre of curvature of the inner surface 11 is denoted by the reference 23. The reference 53 indicates an axis of withdrawal rotation of the formers which are used to cast the channel 10 in each case. In FIG. 2, the reference 83 indicates an axis of rotation of the formers—in this case, the axis of rotation 83 is outside the volume of the panel 1 to be cast, as is the case in the prior art former assembly discussed above. It would not be possible to cast the channel shapes shown in FIGS. 2 and 3 using the prior art former assembly, because the formers would interfere with the concrete when an attempt was made to withdraw them.

By arranging the centre of rotation 53 between the centres of rotation 23 and 73 of the inner and outer surfaces 11 and 16 of the channel 10, it is possible to ensure that the formers are able to rotate without interference with the cured casting material when they are withdrawn from the cast facing element. Two variants of this arrangement are shown in FIGS. 2 and 3.

However, it is not possible to adapt the prior art former assembly such that the centre of rotation 83 of its hinge is moved to be inside the volume of the facing element 1.

Therefore, a new arrangement of formers has been proposed, which will be described with reference to FIGS. 4 to 14. In particular, it will be seen that the former assembly described in this application comprises former elements which can be withdrawn by both rotation around a centre of rotation 53 and by translation away from the rear face, for example parallel to, or substantially parallel to, the axis A.

Figure 4:
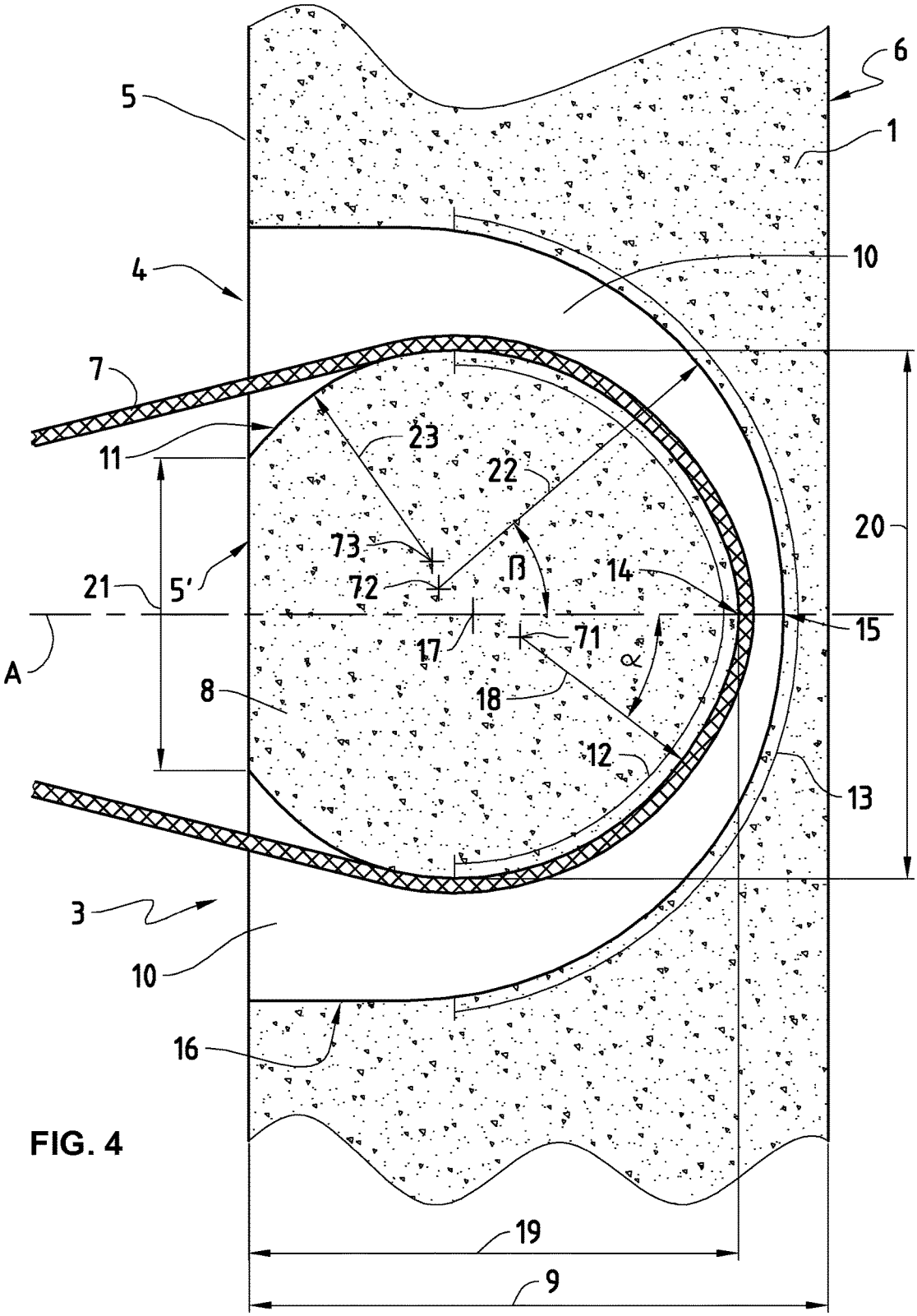
FIG. 4 shows in schematic cross-section a loop channel for a facing element according to the first embodiment of the invention.

The recess channel 10 shown in FIG. 4 extends from the rear face 5 almost to the front face 6 of the facing element 1. In the example shown in FIG. 4, the core element 8 is approximately cylindrical, with a flat face 5' in the plane of the rear face 5 of the facing element 1. However, it should be appreciated that the core element 8 could be formed with other shapes of cross-section. The terms "cylinder" and "cylindroids" are used in this application to refer to a family of shapes with a variety of cross-sections, but whose cross-section is substantially constant over at least the part of the length of the core element 8 which is designed to come into contact with the reinforcing strip 7.

FIG. 4 shows a similar channel 10 to the channel 10 depicted in FIG. 3. In this case, the inner surface 11 and the outer surface 16 of the channel have a varying radius of curvature, at least over part of their surface. A reinforcing strip 7 is illustrated passing through the first opening 3, round the core element 8 through channel 10, and out again at a second opening 4. The channel 10 in this first example embodiment has an inner surface 11, of which at least a forward-facing part, 12, is in contact with the strip 7, and has a varying radius of curvature 18. In particular, the radius of curvature 18 of the forward-facing inner surface 12 advantageously decreases from the point 14, referred to as the distal point of the core element 8, towards the rear face 5, with increasing angle $\alpha$, over all or most of the forward-facing portion 12 of the surface 11, 12. The forward-facing portion 12 is that part of the surface 11 of core element 8 which has a surface normal parallel to or directed away from the rear surface 5. In this application, the surface normal of a solid object is generally taken to be directed away from the solid object.

The shape of the core element 8 is shown as being symmetrical about a centre-line A, and the description of the variation of the radius of curvature refers to the surface on one side of the centre-line A, assuming that the shape of the forward-facing surface 12 is also symmetrical about A. However, it will be understood that the core element 8 may be asymmetrical about the axis A, in which case the variation in radius of curvature will follow a different pattern on either side of A. The radius of curvature 18 of the surface portion 12 at a particular point may thus define a centre of curvature denoted by reference 71.

In this illustration, the radius of curvature 22 of the outer surface of the channel, at least in the part indicated by reference 13 (referred to as the concave, rearward-facing portion 13 of the outer surface 16 of the channel), varies little with increasing angle $\beta$. In this case, therefore, the outer surface portion 13 has a single centre of curvature, denoted by reference 72. The radius of curvature 22 can also vary with angle $\beta$, however, in order to achieve greater core depth while still permitting easy withdrawal of the former elements. A principal axis of the core element 8 is denoted by 17, being substantially a central axis of the core element 8. 23 and 73 denote respectively the centre and radius of curvature of a rearward facing part of the inner surface of the core element 8. 20 denotes the width of the core element 8 at its widest point as measured in a direction parallel to the rear face 5 and perpendicular to the principal axis 17 of the core element 8. Reference 9 indicates the depth of the core element 8 as measured in a direction perpendicular to both the rear face 5 and the principal axis 17. Reference 21 denotes a separation distance between the first and second openings 3 and 4 in the plane of the rear face 5. It is advantageous to minimize the separation distance 21 such that, when the two emerging portions of strip 7 are covered with a significant weight of earth, and therefore pressed towards each other, the ends localized stress on the strip is kept to a minimum, while still maintaining a sufficient width 20 of the core element to give the core element 8 adequate strength to bear the lateral loads (tension on the strip) which arise when the volume behind the facing element is back-filled.

In summary, the channel 10 may be formed such that one or both of the convex inner surface 12 and the concave outer surface 13 of the channel has a radius of curvature which generally varies (eg decreases/increases) from the deepest part of the recess in a direction towards the rear face, at least over a part of the respective surface. Because of this varying radius of curvature, the central core of the channel can be cast deeper and narrower, and with openings which are closer together, than has hitherto been possible using removable void formers. Such a deep and narrow channel may not however be formed using known removable void formers, and the conventional method of casting such recesses has therefore been to use cast-in moulds which remain in the concrete once it is set. This is a costly and inconvenient solution, so there is a need for a method of casting a deep and narrow recess channel 10 without resorting to the inconvenience and cost of providing such cast-in moulding inserts.

FIGS. 5 to 9 show a void former assembly which, according to a first embodiment of the invention, can be used to cast deep and/or narrow recesses as described above. The assembly comprises two void formers 31 and 32, held in position for casting by support means 34, 35. The two void formers 31 and 32 are shaped as curved wedges, and are shaped so that the wedge tips meet at a keyed surface with key 33, thereby defining the shape of the arcuate channel void 10 and core element 8 already described in relation to FIGS. 1 to 4. As will be described below, the support means 34 are adapted to permit the withdrawal of void formers 31 and 32 such that they are able not only to rotate around the core element 8, but also to be withdrawn from the cast concrete 1 with a translational displacement. Support means 34, 35 may comprise, for example a cross-beam arrangement to which can be secured a brace 34. In the illustrated example, the brace 34 comprises a threaded rod and nut 55, 56 designed to clamp a rigid spacer element 57 between the top pieces 47 of the two void formers 31 and 32 such that the void formers 31 and 32 are held in position during casting of the concrete facing element 1. The brace 34 can then release the void formers 31, 32 once the concrete has sufficiently cured. Thus released, the void formers 31 and 32 can be withdrawn, by rotation and translation, from the cast concrete. In this simple illustration of an example of the invention, the first and second void formers are each one rigid element, and the support means 34, 35 comprises a simple bracing or clamping device for either holding or releasing the void formers. The void formers 31 and 32 are thus withdrawn by exerting initially a rotational force and then a translational force on each void former in order to withdraw the void formers 31 and 32. The withdrawal displacement means may for example be a lever (not shown) for engaging with the top part 47 of each void former 31, 32. Alternatively, or additionally, the withdrawal displacement means may comprise a mechanism for urging the void formers 31 and 32 along the rotational and translational directions. Such a mechanism is not illustrated in the figures.

Figure 5:
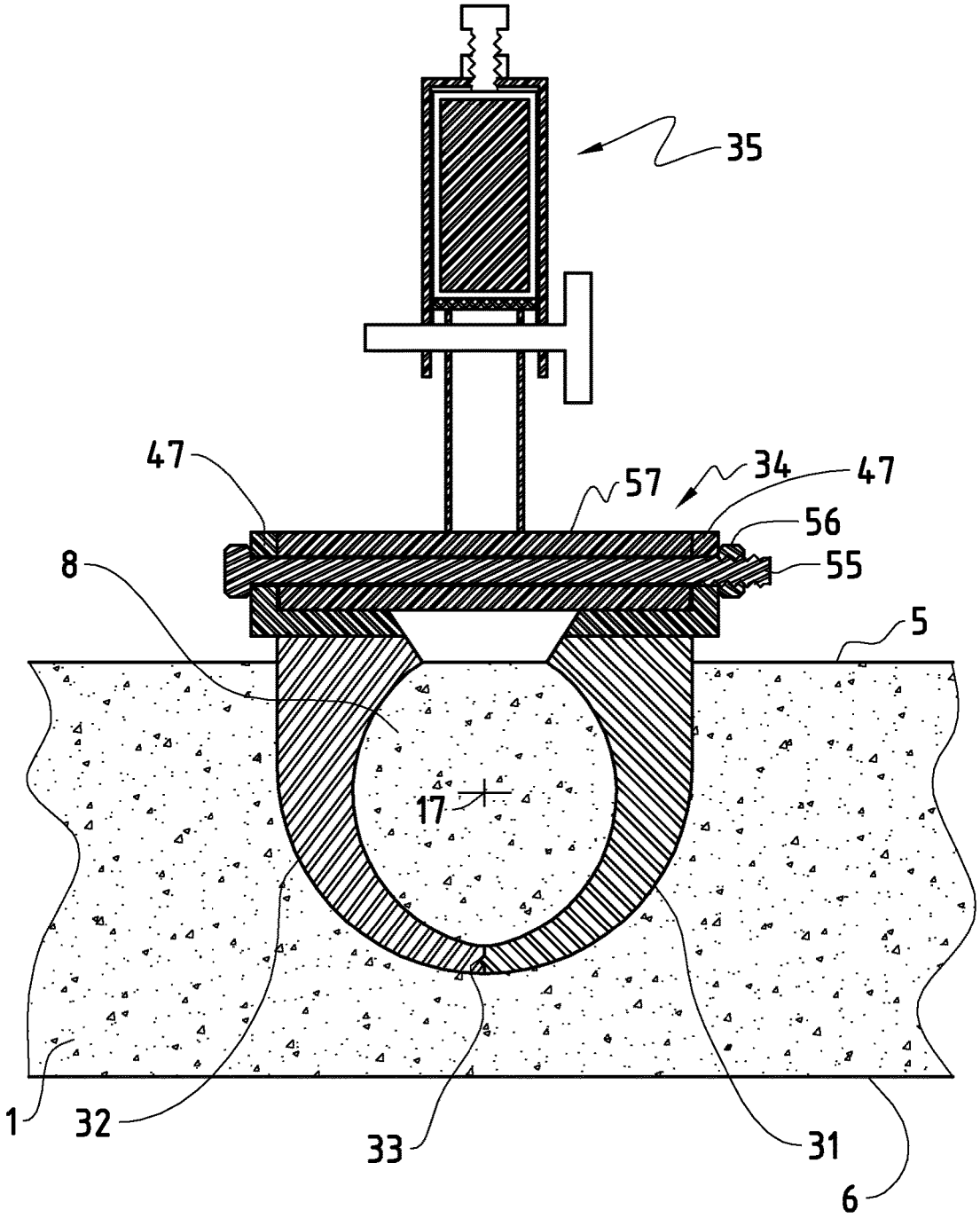
FIG. 5 shows in schematic cross-section a void former assembly for forming a loop channel for a facing element according to the first embodiment of the invention.
Figure 6:
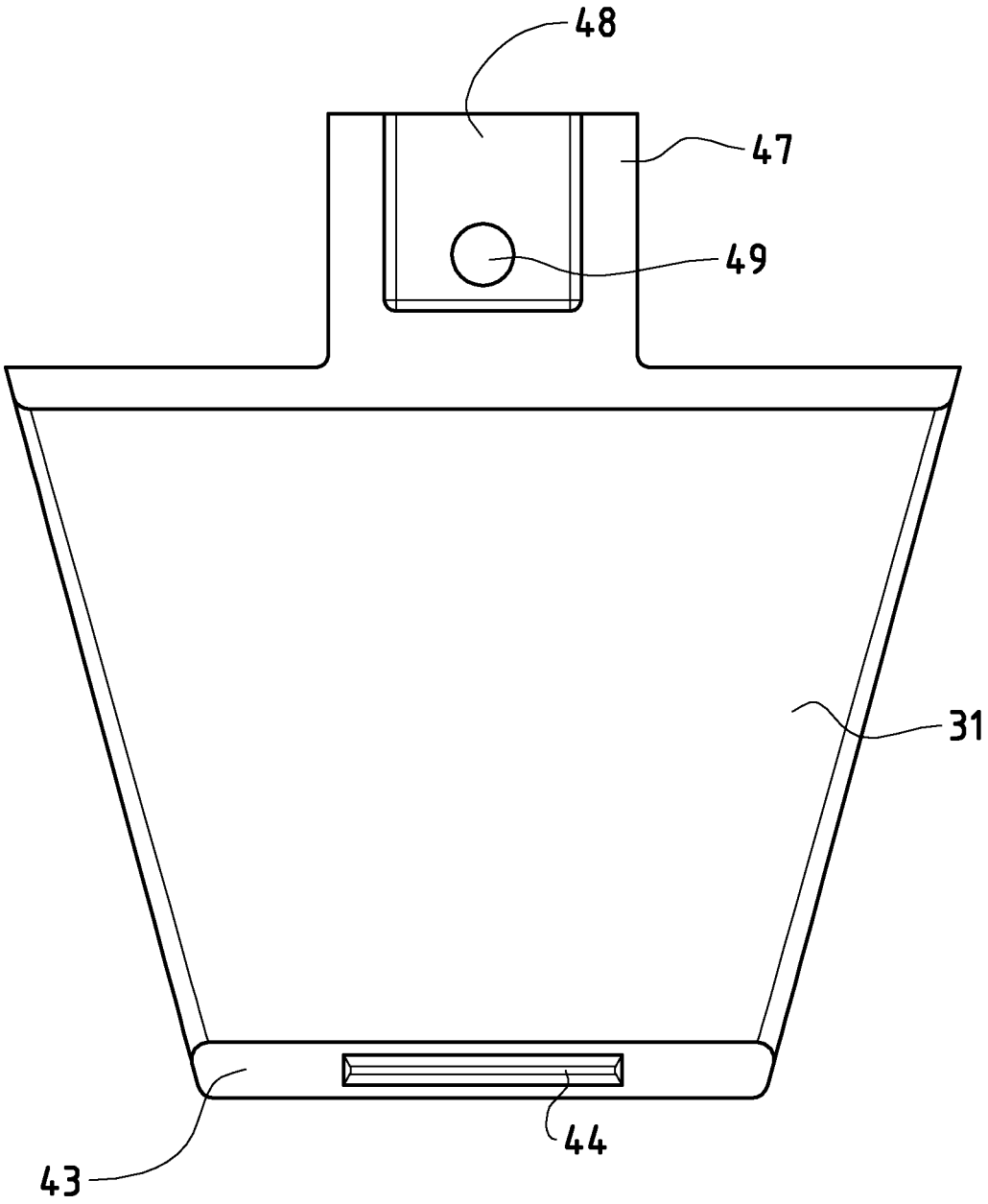
FIGS. 6 to 8 show three orthogonal projections of a void former for forming a facing element according to the first embodiment of the invention.
Figure 7:
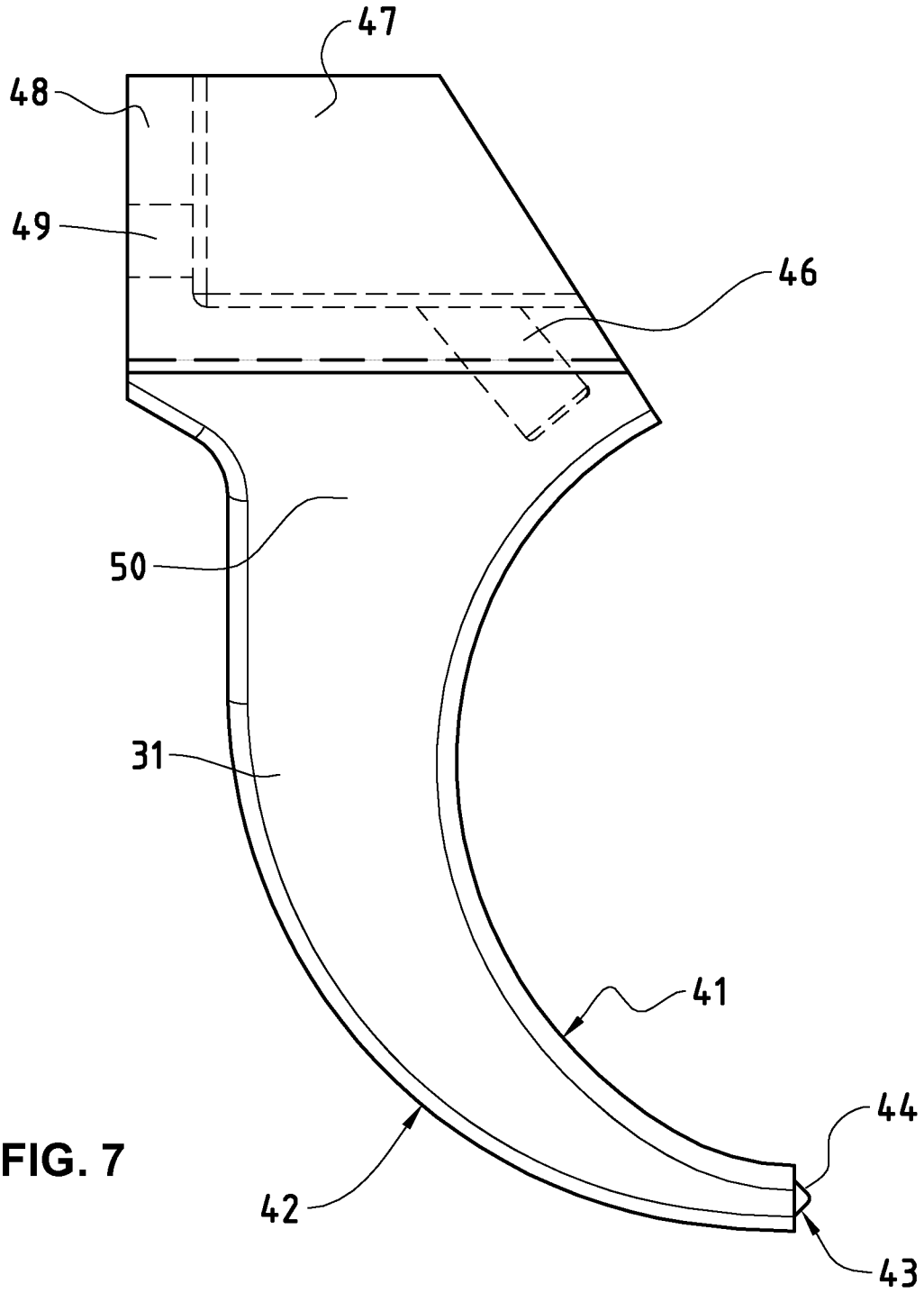
Figure 8:
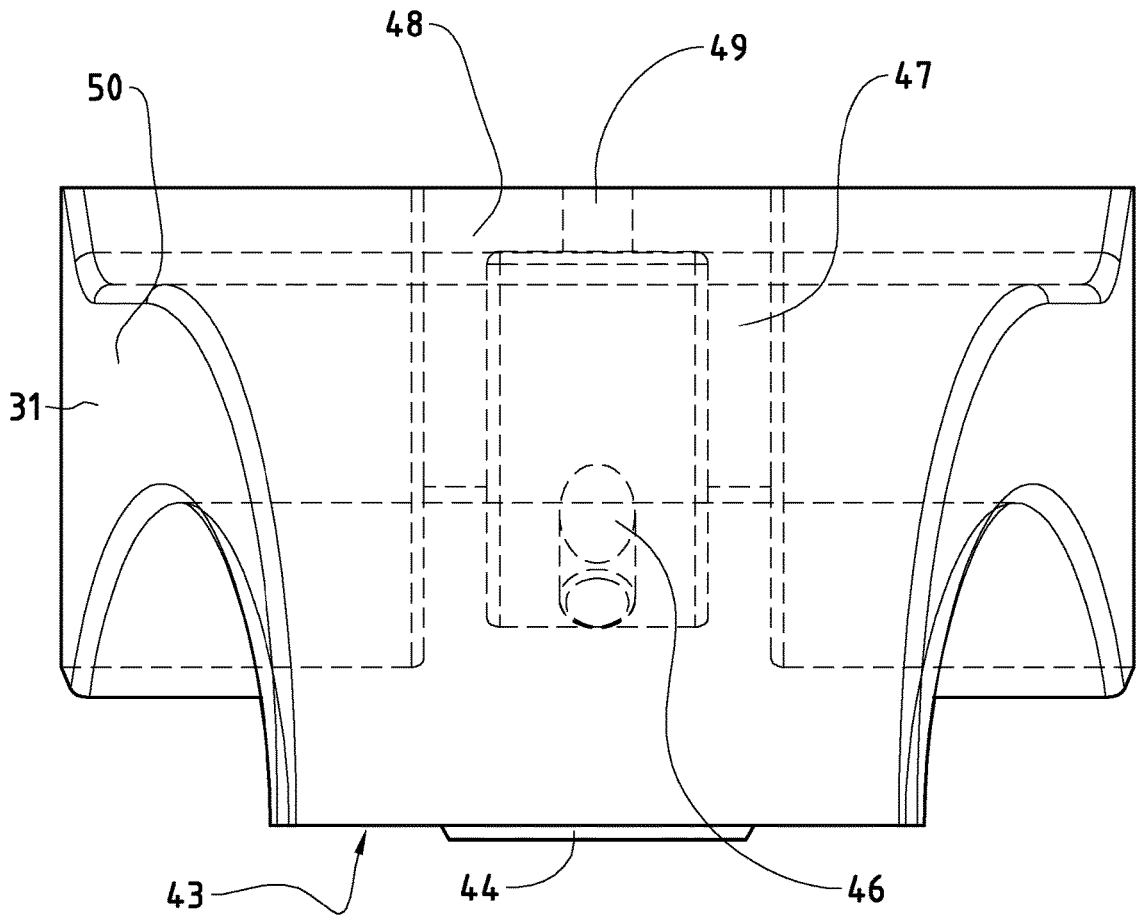
Figure 9:
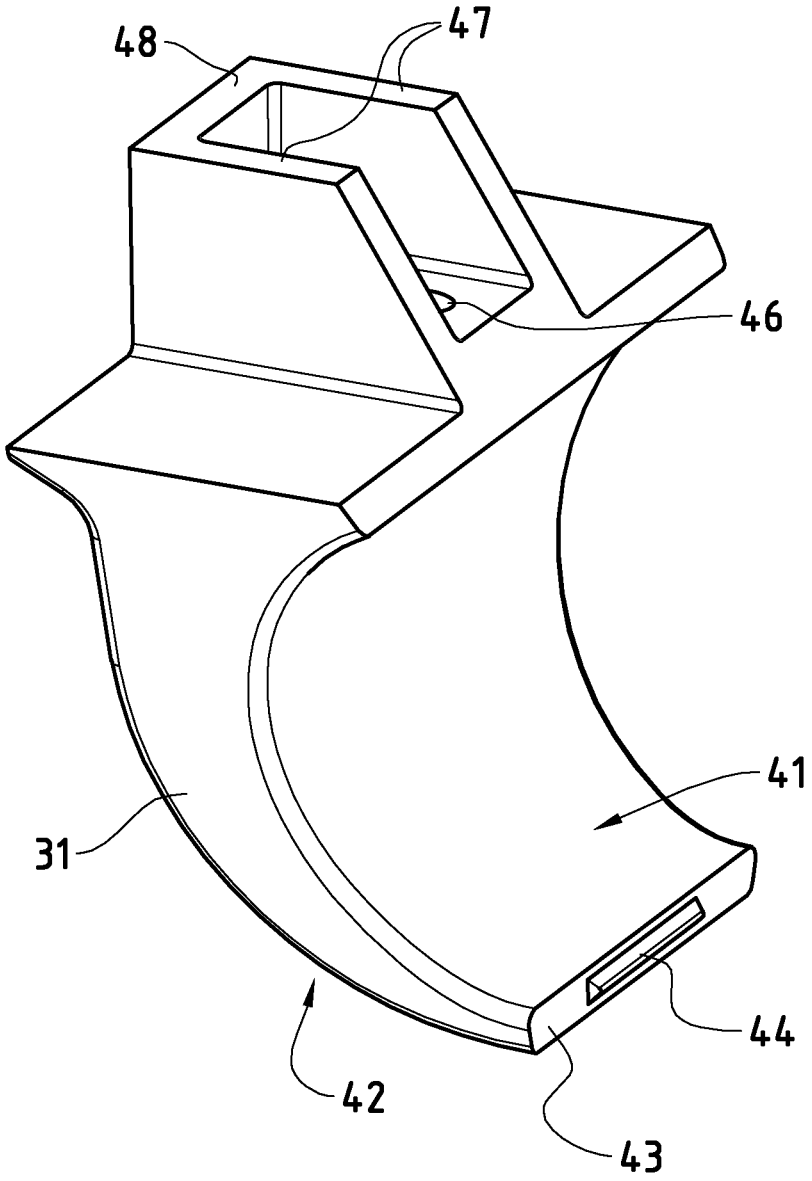
FIG. 9 shows a perspective projection of the void former of FIGS. 6 to 8.

FIGS. 6 to 9 show various schematic views of the void formers 31 illustrated in FIG. 5. The curved wedge shape of void former 31 is clearly visible in side view in FIG. 7, and in perspective view in FIG. 9. As can also be seen from FIGS. 6 and 8, the curved wedge shape of void former 31 may also have, in addition to the thickness taper of the curved wedge shape, a width taper from top (wider) to bottom (narrower) in order to further ease the withdrawal of the void former 31 from the casting.

The top of the void former 31 is provided with withdrawal displacement means in the form of bracket 46, 47, 48, which serves both as an engagement part for engaging a lever or other tool in order to give the void former the rotational and translational force required to withdraw it from the casting. The bracket 46, 47, 48 also serves to clamp the void former 31 to its counterpart 32 as described with reference to FIG. 5. Hole 49 is provided in the bracket for accommodating the threaded rod 55 of FIG. 5. Another hole, 46, is provided for inserting a lever, for example, which can then be used for rotating the void former 31 about the core element 8. Reference 50 indicates an upper (rear) portion of the void former 31, while references 41 and 42 indicate the inner and outer surfaces respectively of the lower (forward) portion of the void former 31. Concave inner lower surface 41 forms the rear-facing convex surface 12 of the core element 8 in FIG. 4, while convex outer lower surface forms the forward-facing concave surface 13 of the channel 10 in FIG. 5. Key 44 and end surface 43 correspond to the meeting of the tips 33 of the void formers 31 and 32 illustrated in FIG. 5.

Figure 10:
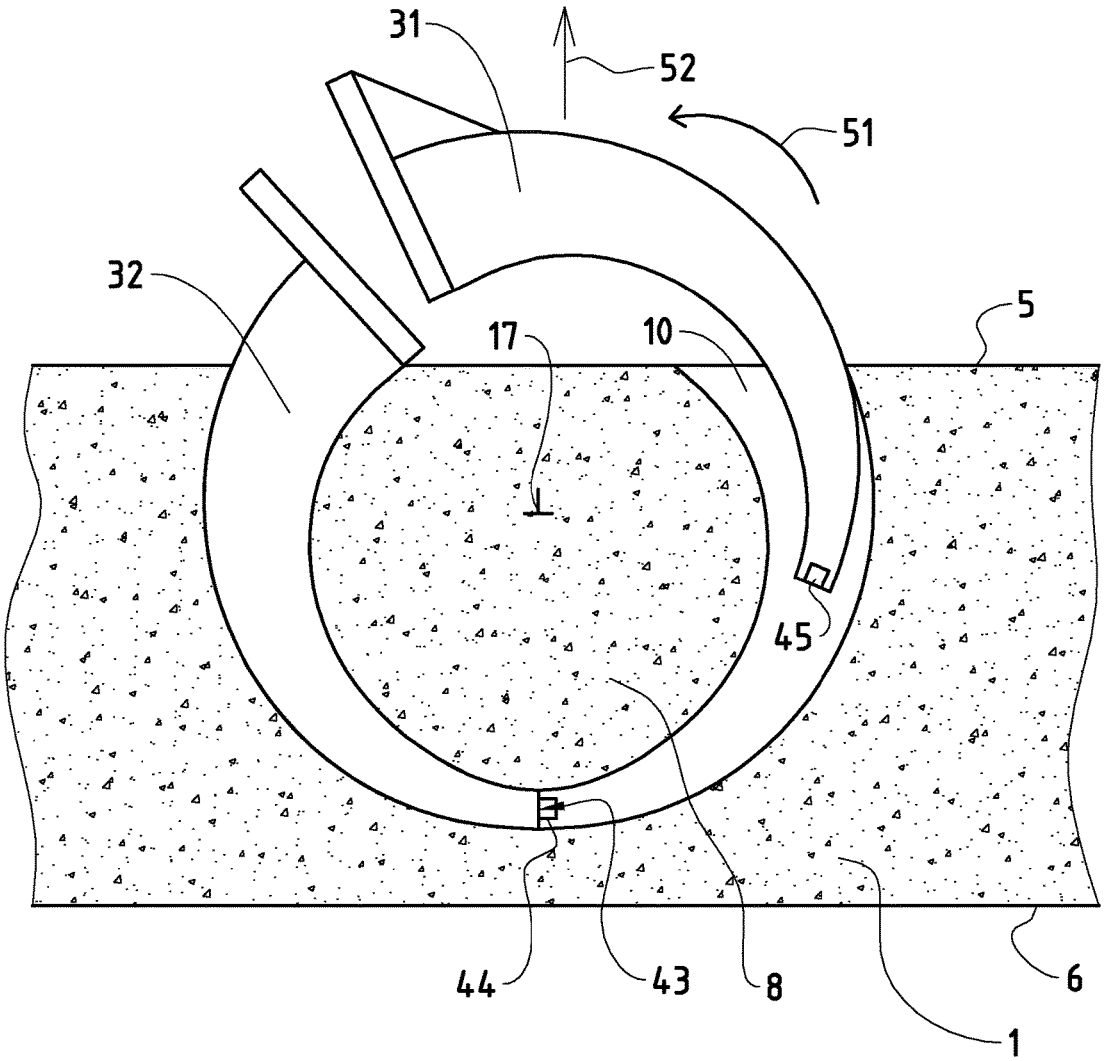
FIG. 10 shows another example former arrangement according to the first embodiment of the invention.

FIG. 10 shows in symbolic representation how the two void formers 31 and 32 can be withdrawn from the casting. Void former 31 is shown having been rotated about the core element 8 along a rotational path indicated approximately by arrow 51, and translated linearly along a direction 52 which in the illustrated example is substantially perpendicular to the rear face 5 of facing element 1. FIG. 10 also shows the engaging parts 44 and 45 of the two void formers 31, 34, which are designed to ensure a continuous void in the channel 10 of the casting. As shown in FIG. 10, the void formers 31 and 32 may be formed such that, when they are being withdrawn from the casting by rotation and translation, neither of the void formers 31 and 32 interferes with the other.

Figure 11:
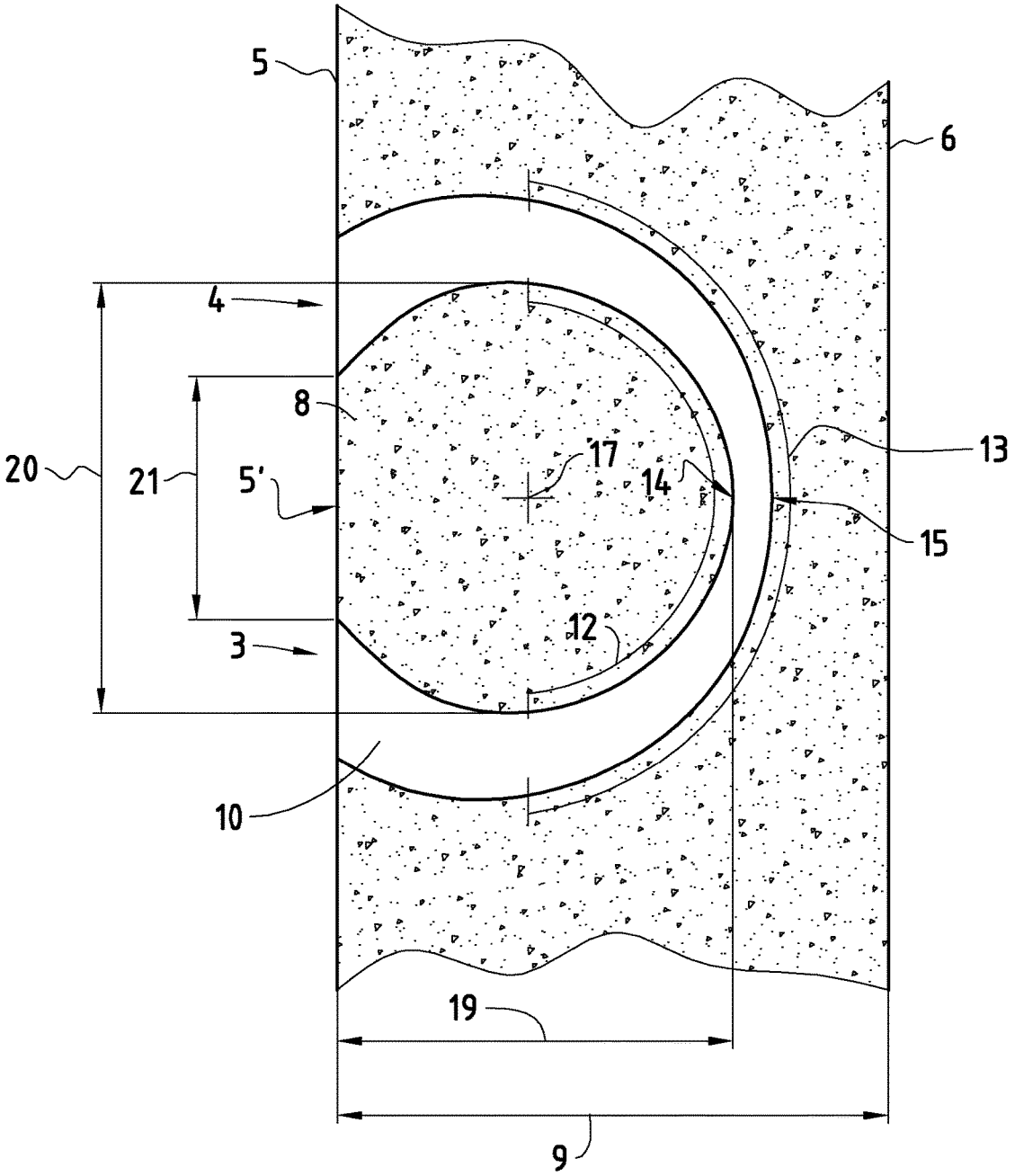
FIG. 11 shows a schematic cross-sectional view of a further loop attachment channel for a facing element which can be formed using the former arrangement of FIG. 10.

FIG. 11 shows the channel 10 and the core element 8 of FIG. 10. As can be seen from FIG. 11, the use of a void former assembly which permits curved wedge-shaped void formers to be withdrawn from the casting by both rotation and translation can result in a channel 10 with much narrower openings 3 and 4 than were hitherto possible using removable void formers. Narrow openings 3 and 4 have the dual advantages that a) the channel void is smaller, which means that the facing element 1 is stronger in the region of the recess, and b) it is easier to prevent the ingress of backfill material (using a protective cover or tape, for example) into the channel.

Figure 12:
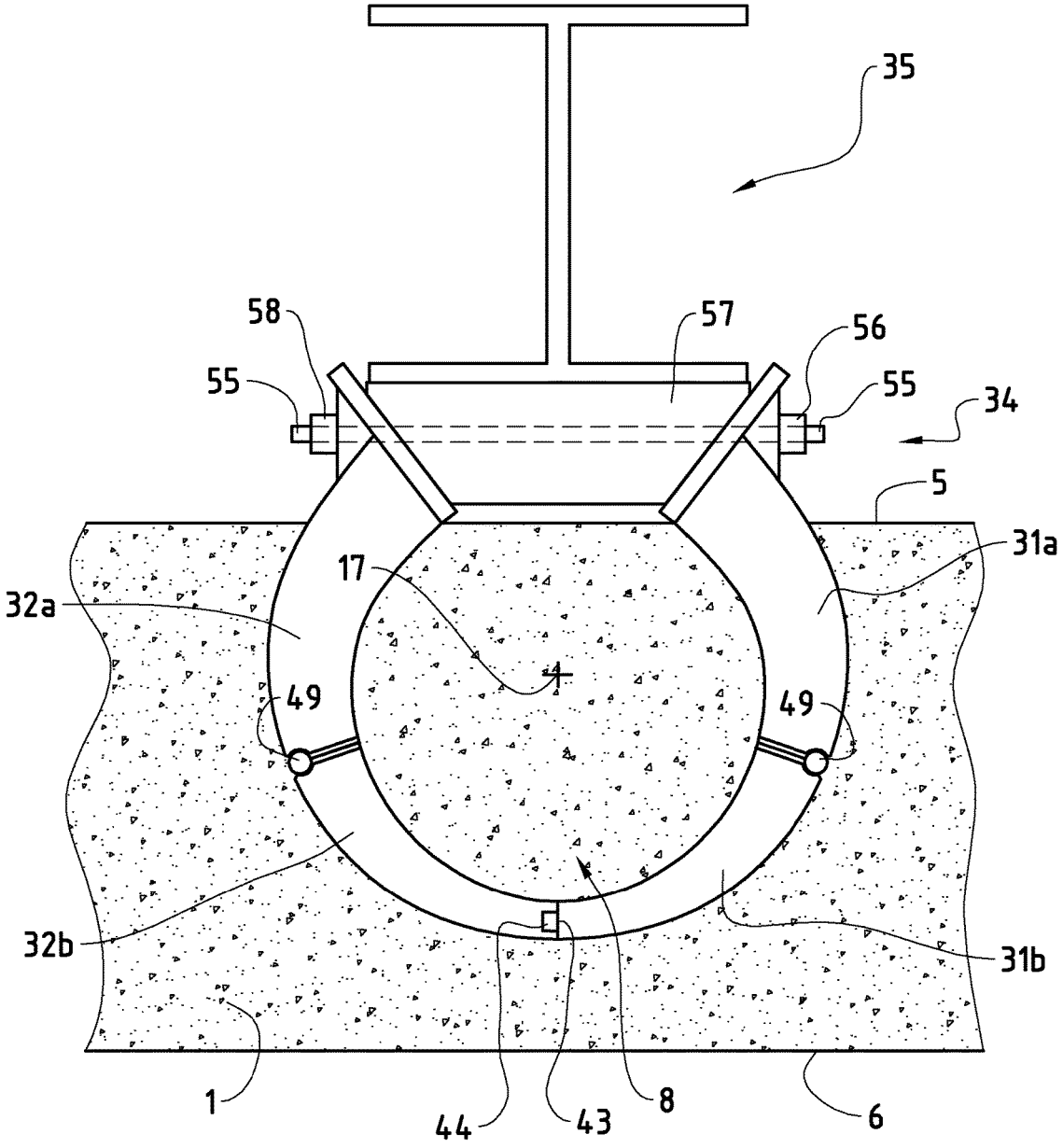
FIG. 12 shows an example void former arrangement for casting a facing element according to a second embodiment of the invention.
Figure 13:
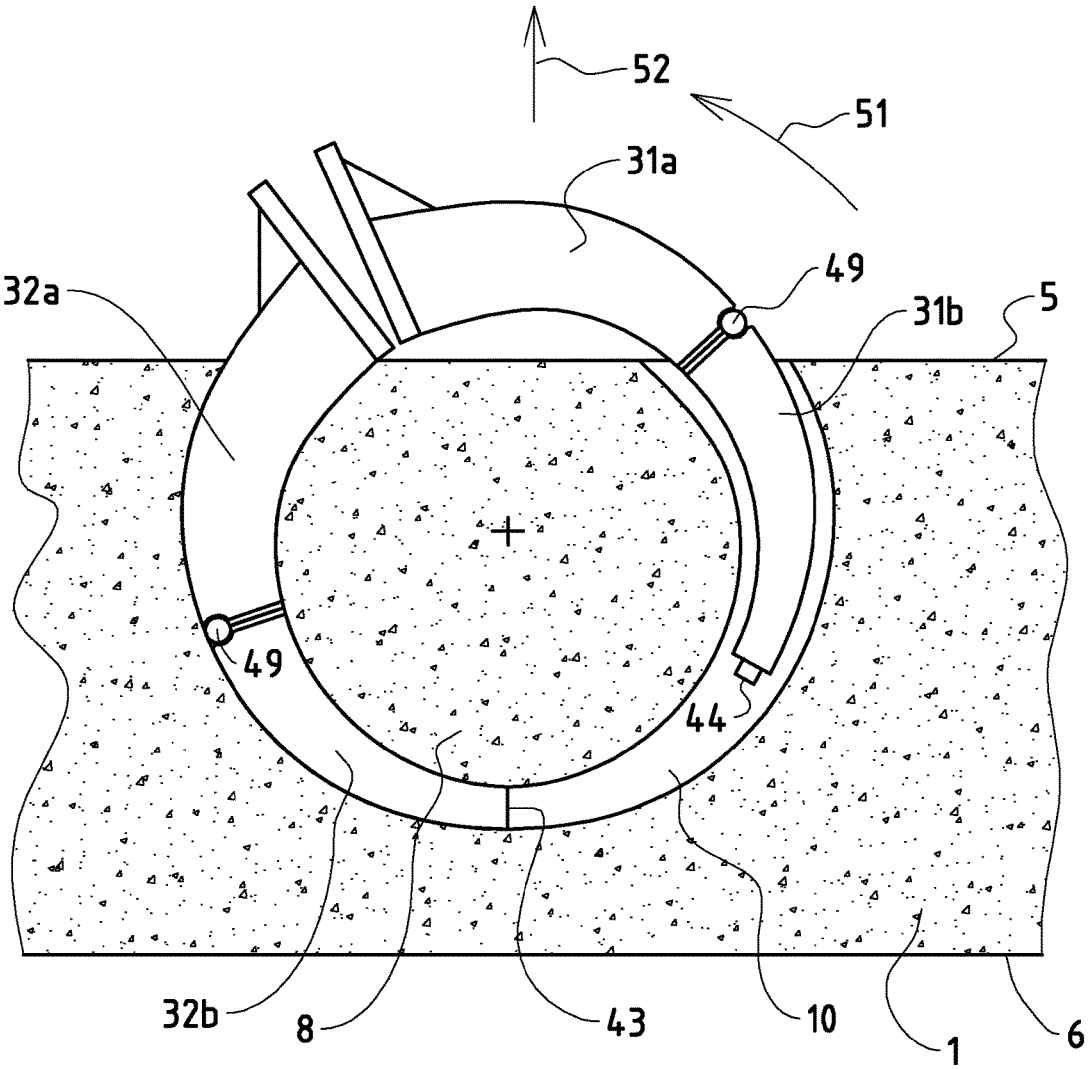
FIG. 13 shows a first withdrawal step of the void former arrangement shown in FIG. 12.
Figure 14:
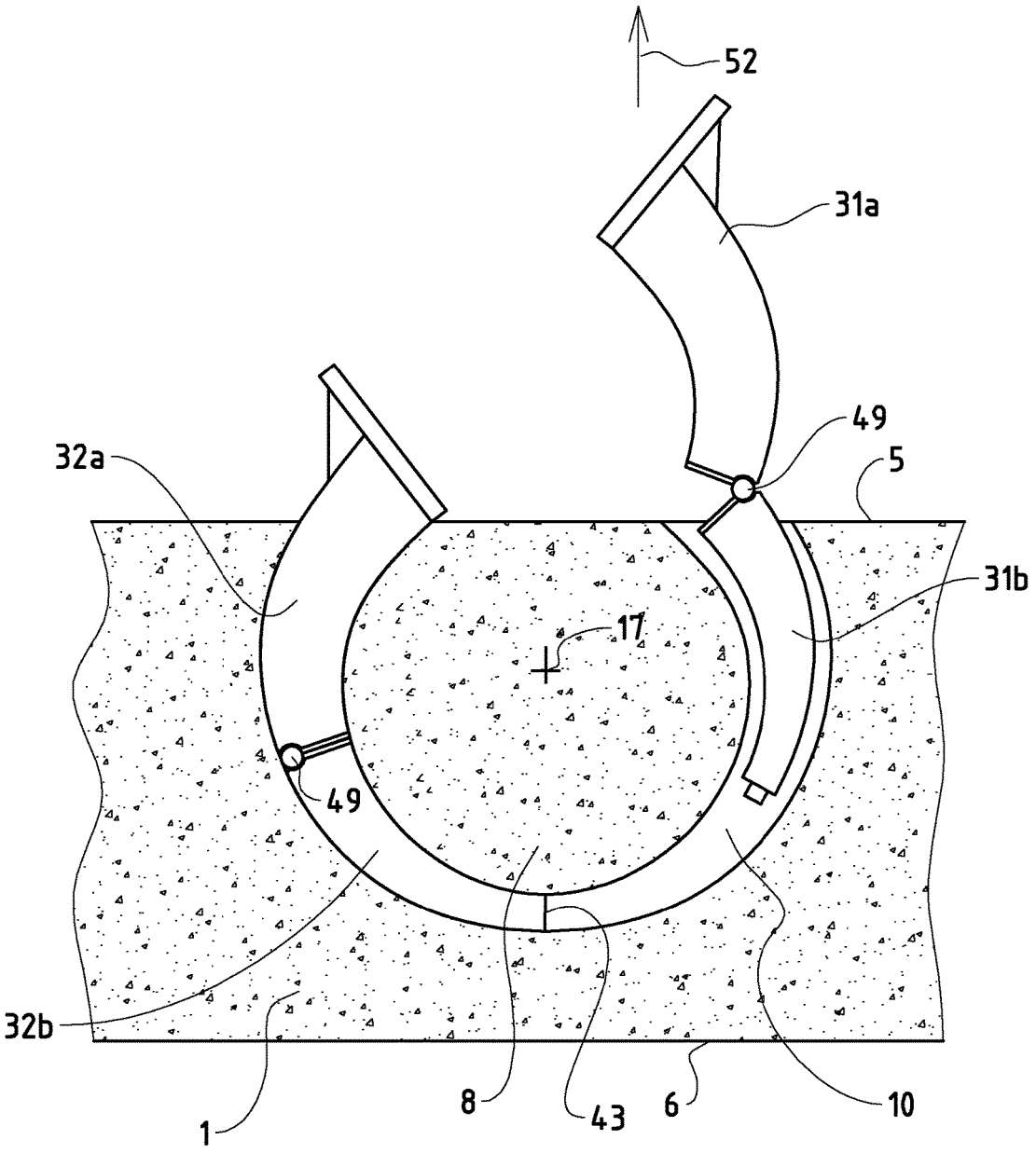
FIG. 14 shows a second withdrawal step of the void former arrangement shown in FIG. 12.

FIGS. 12 to 14 show a void former according to a second embodiment of the invention. In this embodiment, one or both of void formers 31 and 32 may be formed in two or more pieces 31*a* and 31*b* or 32*a* and 32*b*, with the two or more pieces comprising mechanical joining means 49 which permit the two or more pieces 31*a* and 31*b* or 32*a* and 32*b* of the void former 31, 32 to hinge or otherwise move relative to one another during withdrawal of the void former from the casting. The joining means 49 can also ensure that the two or more void former pieces 31*a* and 31*b* or 32*a* and 32*b* are withdrawn together in the same rotation/translation displacement.

As in the first embodiment, the void formers 31 and 32 are held in position by support means 34, 35, with their tips engaged for example using keyed engaging means 43, 44. As shown in FIGS. 13 and 14, the hinged or otherwise joined void former pieces 31*a* and 31*b* or 32*a* and 32*b* can be rotated about the core element 8 in direction 51, and then withdrawn by translation in a linear direction 52 (in this case substantially perpendicular to the rear face 5 of the facing element 1). By using jointed or otherwise joined void former pieces 31*a* and 31*b* or 32*a* and 32*b*, the channel 10 can be made yet narrower, and/or the core element 8 can be made yet narrower and/or deeper, since the potential interference which is visible in FIG. 10 when withdrawing two one-piece void formers 31, 32 is largely eliminated. The joint(s) connecting the void former pieces may be implemented as hinges 49, as indicated in FIGS. 12 to 14, or as cords or wires or chains which can be used to hold the void former pieces together and then release them sufficiently to allow the void formers pieces to flex relative to one another as they are withdrawn.

The void formers 31 and 32 may be constructed from any suitable rigid or semi rigid material. Advantageously, they can be constructed from a hard-wearing material such as a metal or a high-density plastics or fibre-reinforced material.

The invention claimed is:

1. Removable void former assembly for displacing a casting material to form a strip anchorage channel in a substantially planar rear face of a cast facing element during casting of the cast facing element, the cast facing element being configured for facing backfill stabilized by means of a flexible reinforcement strip passed through the strip anchorage channel such that the strip follows a substantially arcuate path between a first channel opening in the rear face, around a substantially cylindrical or cylindroidal core element, the core element being cast contiguously with the cast facing element, to a second channel opening in the rear face, wherein the removable channel void former assembly comprises:

a first void former, shaped for forming a first part of the strip anchorage channel, the first part of the strip anchorage channel extending between the first channel opening and an intermediate location in the strip anchorage channel, a second void former, shaped for forming a second part of the strip anchorage channel, the second part extending between the second channel opening and the intermediate location, support means for supporting the first and second void formers in position during casting of the cast facing element, and withdrawal displacement means for rotationally displacing the first and/or second void formers about the core element in a rotational withdrawing direction from the strip anchorage channel of the cast facing element, the first void former being decouplable from the second void former such that the first void former can be withdrawn from the cast facing element substantially without mechanical interaction between the first void former and the second void former, wherein the withdrawal displacement means are configured for performing, in addition to the rotational displacement of the first and/or second void formers about the core element in a rotational withdrawing direction, a linear translational displacement of the first and/or second void formers along a linear withdrawal direction.

2. Removable void former assembly according to claim 1, wherein the linear translational displacement comprises a component perpendicular to the plane of the rear face.

3. Removable void former assembly according to claim 1, wherein the linear translational displacement of the first void former is along the linear withdrawal direction and is also a translational displacement relative to the second void former.

4. Removable void former assembly according to claim 1, wherein the first void former comprises a substantially cylindrically or cylindroidally curved wedge shaped portion having:

a concave former surface region for forming a convex core surface region of the core element, the convex core surface region being a portion of the surface of the core element which has a surface normal directed away from the rear face, a convex former surface region for forming a concave channel surface region of the strip anchorage channel, the concave channel surface region being a portion of the surface of the strip anchorage channel which faces the convex core surface region, a distal end for cooperating with a corresponding distal end of the second void-former, wherein the radius of curvature of the concave former surface region varies, along at least a majority of the concave former surface region in a direction away from the distal end, and/or the radius of curvature of the convex former surface region varies, along at least a majority of the convex former surface region in a direction away from the distal end.

5. Removable void former assembly according to claim 1, wherein the first void former comprises a substantially cylindrically or cylindroidally curved wedge shaped portion having:

a concave former surface region for forming a convex core surface region of the core element, the convex core surface region being a portion of the surface of the core element which has a surface normal directed away from the rear face, a convex former surface region for forming a concave channel surface region of the strip anchorage channel, the concave channel surface region being a portion of the surface of the strip anchorage channel which faces the convex core surface region, a distal end for cooperating with a corresponding distal end of the second void-former, wherein the radius of curvature of the concave former surface region decreases, or is substantially constant, along at least a majority of the concave former surface region in a direction away from the distal end, and/or the radius of curvature of the convex former surface region increases, or is substantially constant, along at least a majority of the convex former surface region in a direction away from the distal end.

6. Removable void former assembly according to claim 5, wherein the concave former surface region of the first void former is shaped such that the rotational displacement thereof has an axis of rotation which passes through the volume of the core element, the void of the strip anchorage channel, or the panel being cast.

7. Removable void former assembly according to claim 1, wherein one or both of the first and second void formers comprises two or more former elements and one or more former element linking means for linking the two or more former elements together.

8. Removable void former assembly according to claim 1, wherein the withdrawal displacement means comprise lever engaging means for engagement with a lever such that the lever can be used to urge the first void former in the rotational withdrawing direction.

9. Removable void former assembly for displacing a casting material to form a strip anchorage channel in a substantially planar rear face of a cast facing element during casting of the cast facing element, the cast facing element being configured for facing backfill stabilized by means of a flexible reinforcement strip passed through the strip anchorage channel such that the strip follows a substantially arcuate path between a first channel opening in the rear face, around a substantially cylindrical or cylindroidal core element, the core element being cast contiguously with the cast facing element, to a second channel opening in the rear face, wherein the removable channel void former assembly comprises:

a first void former, shaped for forming a first part of the strip anchorage channel, the first part of the strip anchorage channel extending between the first channel opening and an intermediate location in the strip anchorage channel, and a second void former, shaped for forming a second part of the strip anchorage channel, the second part extending between the second channel opening and the intermediate location, the first void former being decouplable from the second void former such that the first void former can be withdrawn from the cast facing element substantially without mechanical interaction between the first void former and the second void former, wherein the first and second void formers are configured such that the first and/or second void formers can only be withdrawn from the cast facing element by a combination of rotational displacement and linear translational displacement thereof.

10. Removable void former assembly according to claim 9, wherein the linear translational displacement comprises a component perpendicular to the plane of the rear face.

11. Removable void former assembly according to claim 9, wherein the linear translational displacement of the first void former is along a linear withdrawal direction and is also a translational displacement relative to the second void former.

12. Removable void former assembly according to claim 9, wherein the first void former comprises a substantially cylindrically or cylindroidally curved wedge shaped portion having:

a concave former surface region for forming a convex core surface region of the core element, the convex core surface region being a portion of the surface of the core element which has a surface normal directed away from the rear face, a convex former surface region for forming a concave channel surface region of the strip anchorage channel, the concave channel surface region being a portion of the surface of the strip anchorage channel which faces the convex core surface region, a distal end for cooperating with a corresponding distal end of the second void-former, wherein the radius of curvature of the concave former surface region varies, along at least a majority of the concave former surface region in a direction away from the distal end, and/or the radius of curvature of the convex former surface region varies, along at least a majority of the convex former surface region in a direction away from the distal end.

13. Removable void former assembly according to claim 9, wherein the first void former comprises a substantially cylindrically or cylindroidally curved wedge shaped portion having:

a concave former surface region for forming a convex core surface region of the core element, the convex core surface region being a portion of the surface of the core element which has a surface normal directed away from the rear face, a convex former surface region for forming a concave channel surface region of the strip anchorage channel, the concave channel surface region being a portion of the surface of the strip anchorage channel which faces the convex core surface region, a distal end for cooperating with a corresponding distal end of the second void-former, wherein the radius of curvature of the concave former surface region decreases, or is substantially constant, along at least a majority of the concave former surface region in a direction away from the distal end, and/or the radius of curvature of the convex former surface region increases, or is substantially constant, along at least a majority of the convex former surface region in a direction away from the distal end.

14. Removable void former assembly according to claim 13, wherein the concave former surface region of at least one of the first and second formers is shaped such that the rotational displacement thereof has an axis of rotation which passes through the volume of the core element, the void of the strip anchorage channel, or the panel being cast.

15. Removable void former assembly according to claim 9, wherein one or both of the first and second void formers comprises two or more former elements and one or more former element linking means for linking the two or more former elements together.

16. Method of forming a strip anchorage channel in a rear face of a cast facing element during casting of the cast facing element, the cast facing element being configured for facing backfill stabilized by means of a flexible reinforcement strip passing through the strip anchorage channel such that the strip follows a substantially arcuate path between a first channel opening in the rear face, around a substantially cylindrical or cylindroidal core element, the core element being cast contiguously with the cast facing element casting, to a second channel opening in the rear face, the method comprising:

a mounting step of arranging a removable channel void former assembly according to claim 1 in a channel casting location of the cast facing element, an unsticking step of rotating the first void former sufficiently to release it from adhesive contact with the cast material, and a withdrawal step comprising a rotational displacement of the first void former about the core element, wherein the withdrawal step includes, in addition to the rotational displacement, a translational displacement of the first void former, the translational displacement having a directional component perpendicular to the rear face.

17. Method according to claim 16, said removable void former assembly further comprising support means for supporting the first and second void formers in position during casting of the cast facing element, the support means comprising releasing means for mechanically decoupling the first void former from the second void former, the method including a releasing step of operating the releasing means to mechanically decouple the first and second void formers from each other.

18. Method according to claim 16, the first and second void formers being configured such that the first and/or second void formers can only be withdrawn from the cast facing element by a combination of rotational displacement and linear translational displacement thereof, wherein the translational displacement comprises a relative displacement between the first and second void formers, along a linear direction away from the rear face.

19. Method according to claim 16, the first and second void formers being configured such that the first and/or second void formers can only be withdrawn from the cast facing element by a combination of rotational displacement and linear translational displacement thereof, wherein the rotational displacement comprises a rotation about a rotation axis which passes through the body of the cast facing element, or through the core element, or through the void of the strip anchorage channel.

* * * * *